US005845450A

United States Patent [19]

Larsen

[11] Patent Number: 5,845,450

[45] Date of Patent: Dec. 8, 1998

[54] BRACING SYSTEM

[76] Inventor: Lyle A. Larsen, Box 68 R.R. 2, Truman, Minn. 56088

[21] Appl. No.: 6,210

[22] Filed: Jan. 13, 1998

[51] Int. Cl.[6] ..... E02D 35/00; E02D 37/00

[52] U.S. Cl. ..... 52/514; 52/293.2; 52/698; 52/167.1; 248/351; 248/354.3; 248/357

[58] Field of Search ..... 52/514, 293.2, 52/698, 167.1, 167.3, 223.7, 223.14; 248/351, 354.3, 357

[56] References Cited

U.S. PATENT DOCUMENTS

| | | | |
|---|---|---|---|
| 377,940 | 2/1888 | Hevner . | |
| 3,537,220 | 11/1970 | Ellis | 52/293.2 X |
| 4,189,891 | 2/1980 | Johnson et al. | 52/514 X |
| 4,353,194 | 10/1982 | Norton | 52/514 X |
| 4,452,028 | 6/1984 | Norton et al. | 52/514 X |
| 4,563,852 | 1/1986 | Achtenberg et al. | 52/514 X |
| 4,757,651 | 7/1988 | Crites | 52/169.5 |
| 4,970,835 | 11/1990 | Harmon | 52/293.2 X |
| 5,620,038 | 4/1997 | DeCola et al. | 52/167.1 X |

*Primary Examiner*—Robert Canfield
*Attorney, Agent, or Firm*—Herman H. Bains

[57] ABSTRACT

A bracing system for bracing a masonry basement wall of a building against inward buckling and cracking due to hydrostatic pressure. The bracing system includes a vertically disposed I-beam positioned against a basement wall to be braced and having a floor plate at its lower end secured to the basement floor. A bracket is secured to the facing floor joist and is adjustable to urge the end of the I-beam against the basement wall. Two different embodiments of the bracket are provided to allow different modes of attachment of the bracket to a floor joist. Load distribution bracket assemblies distribute the load exerted against the I-beam and adjacent floor joist to other floor joists.

5 Claims, 3 Drawing Sheets

40
53
51
53
42
52
54
55
24a
47
41
48
50
50a
47
49
46a
48
43
44
45
46a 15
13
14
11
8
13
8
42
24a
52
41
47
54
55
50
51
47
44
45
24a
43
12
42
24a
52
41
47
50
55
54
44
51
47
48
45
43
12
21
24
20
26
27
22
22
27
26
16
19
14
12

13
24a
44
51
24a
55
50a
54
44
13
21
22
26
16
17
18
25
11
14
45
47
52
54
50
41
49
47
45
24
21b
27
25
18

BRACING SYSTEM

FIELD OF THE INVENTION

This invention relates to a bracing system for bracing a masonry basement wall against buckling due to hydrostatic pressure.

BACKGROUND OF THE INVENTION

Basement walls of buildings including residential buildings are subject to inward buckling due to hydrostatic pressure. Water will sometimes accumulate exteriorly of the basement wall resulting in hydrostatic pressure exerted against the basement wall causing the inward buckling or cracking.

Basement systems have been developed for bracing basement walls against inward buckling. For example, U.S. Pat. No. 3,537,220 discloses a bracing system for masonry walls including a tension rod secured at its upper end to the masonry wall.

U.S. Pat. No. 4,757,651 discloses a vertical wall brace secured at its upper end to a pair of adjacent floor joists.

U.S. Pat. 4,452,028 and U.S. Pat. No. 4,189,891 disclose other bracing systems for bracing masonry walls against inward buckling.

SUMMARY OF THE INVENTION

It is an object of this invention to provide a novel and improved bracing system, of simple and inexpensive construction, for bracing a masonry basement wall against inward buckling and cracking due to hydrostatic pressure.

Another object of this invention is to provide a bracing system for masonry basement walls including a vertical I-beam secured to the floor of the basement and engaged at its upper end by a bracket secured to a floor joist.

The novel bracing system includes a vertically disposed I-beam which is positioned against a basement wall and is bolted to the basement floor by a floor plate affixed to the lower end of the beam. A novel bracket secured to an adjacent floor joist engages the upper end of the I-beam and urges the I-beam against the basement wall. A load distributing bracket assembly distributes the load from the braced wall to adjacent floor joists.

DESCRIPTION OF THE PREFERRED EMBODIMENT

Figures 1, 2, 3:
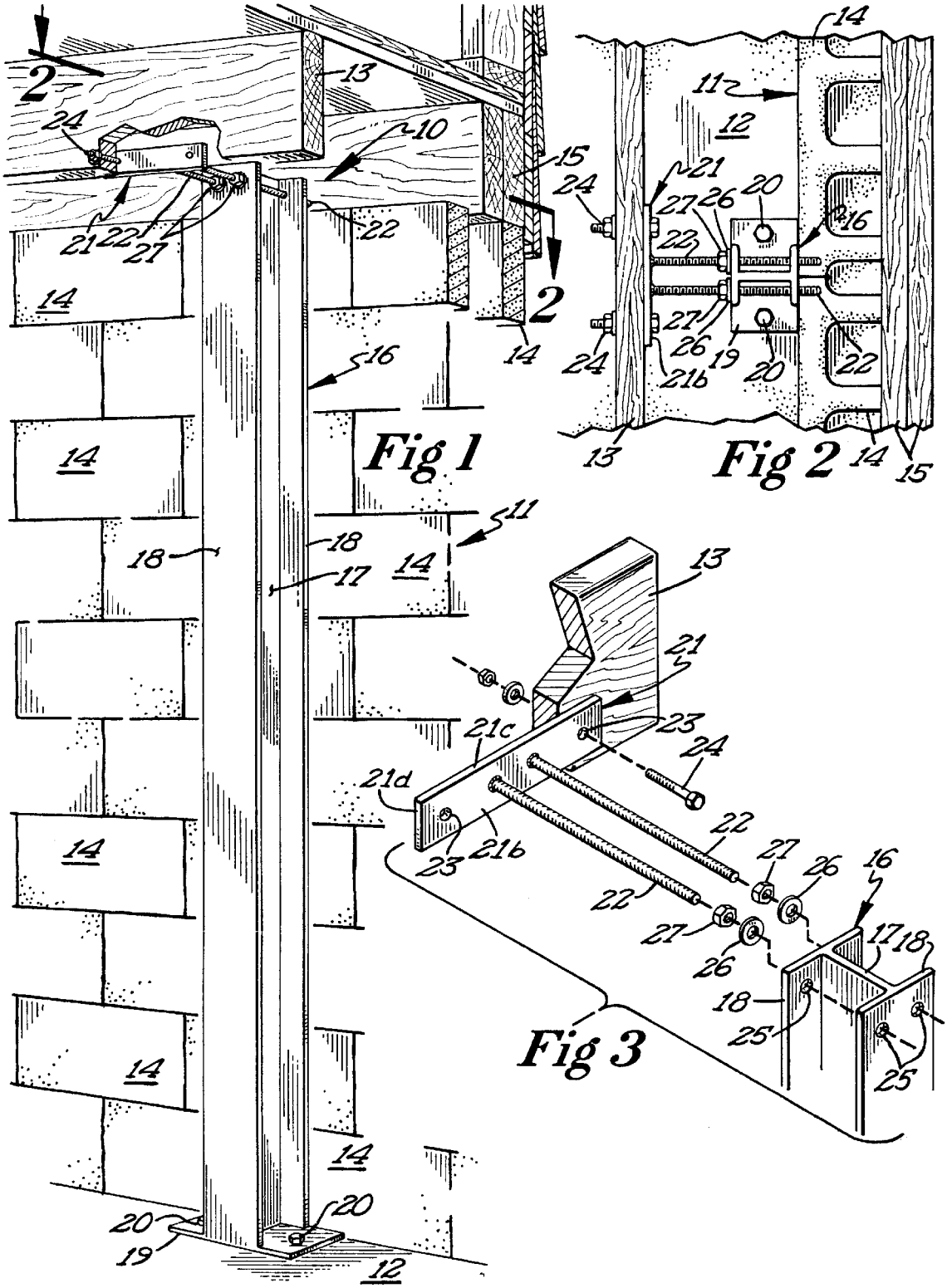
FIG. 1 is a perspective view of the novel bracing system illustrating the system in bracing relation with respect to a masonry basement wall.
FIG. 2 is a cross-sectional view taken approximately along 2—2 of FIG. 1 and looking in the direction of the arrows.
FIG. 3 is a fragmentary exploded perspective view illustrating how the novel bracket urges the upper end portion of an I-beam against the basement wall.

Referring now to the drawings and more specifically to the FIGS. 1–3, it will be seen that one embodiment of the novel bracing system, designated generally by the reference numeral 10, is thereshown. The bracing system 10 is illustrated in engaging relation with a vertical masonry basement wall 11 comprised of concrete blocks 14. The basement is of conventional construction and includes a basement floor 12 with the masonry walls extending upwardly therefrom. The floor joists 13 for the floor of the building are positioned upon the upper layer of the concrete blocks 14 and secured at their respective ends to conventional plates 15.

The bracing system includes an I-beam 16 which is comprised of a central web 17 having flanges 18 integrally formed therewith and extending therefrom. In the embodiment shown, a four by three (4×3) inch I-beam is used although other size I-beams may also be used. The length of the beam will be dependent on the height of the basement. The lower end portion of the I-beam 16 is secured to a substantially flat rectangular floor plate, preferably by welding. The floor plate 19 is secured to the floor by suitable bolts 20.

The upper end portion of the I-beam is secured against the masonry wall by the bracket 21 which is secured to the facing floor joist. The bracket 21 comprises a flat rectangular plate having opposed surfaces 21*b*, parallel longitudinal edges 21*c*, and parallel transverse edges 21*d*. A pair of elongate threaded members 22 are rigidly secured to one surface 21*b* thereof and projecting therefrom. The bracket 21 is also provided with a pair of openings 23 for accommodating a pair of nut and bolt assemblies 24 which rigidly secure the bracket to a floor joist facing and spaced from the masonry wall to be braced. It will be noted that in the embodiment shown, the threaded members 22 are secured to the surface 21*b* along the longitudinal centerline of the plate 21*a*.

Each flange 18 of the I-beam is provided with a pair of openings 25 therein. It will be noted that each opening 25 in one flange is disposed in aligned relation with an opening in the other flange. When the I-beam is positioned against the masonry wall, one flange 18 will be disposed in bearing relation with the wall. The openings 25 in the I-beam flanges are located above the edge surface of the uppermost row of blocks. The elongate threaded members 22 project through the openings 25 in the flanges and are tightened against a flange by washer 26 and nut 27 to clamp the I-beam against the masonry wall 21. When each nut 27 is tightened against the I-beam, the I-beam is progressively urged against the masonry wall. The reaction force will be transmitted via the I-beam and bracket to the floor joist.

When the bracing system is secured against a vertical basement wall 11, then a substantial area of the wall will be braced by the bracket 21, I-beam 16 and floor joist 13 against inward buckling and cracking due to hydrostatic pressure. If the wall has buckled inwardly as a result of hydrostatic pressure, then the bracing system engaging such a wall will result in the wall eventually resuming its straightened non-buckled condition. The bracket, I-beam and floor plate can be readily installed with a minimum of effort and provides resistance to buckling in an extremely effective way.

Figure 4:
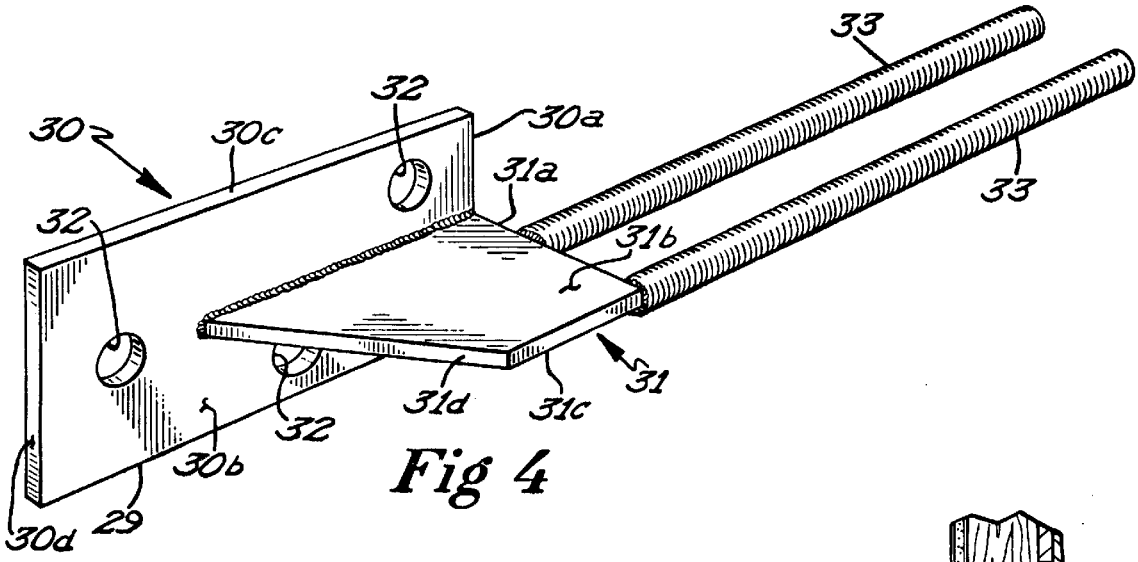
FIG. 4 is an enlarged perspective view of a second embodiment of the novel bracket.
Figure 5:
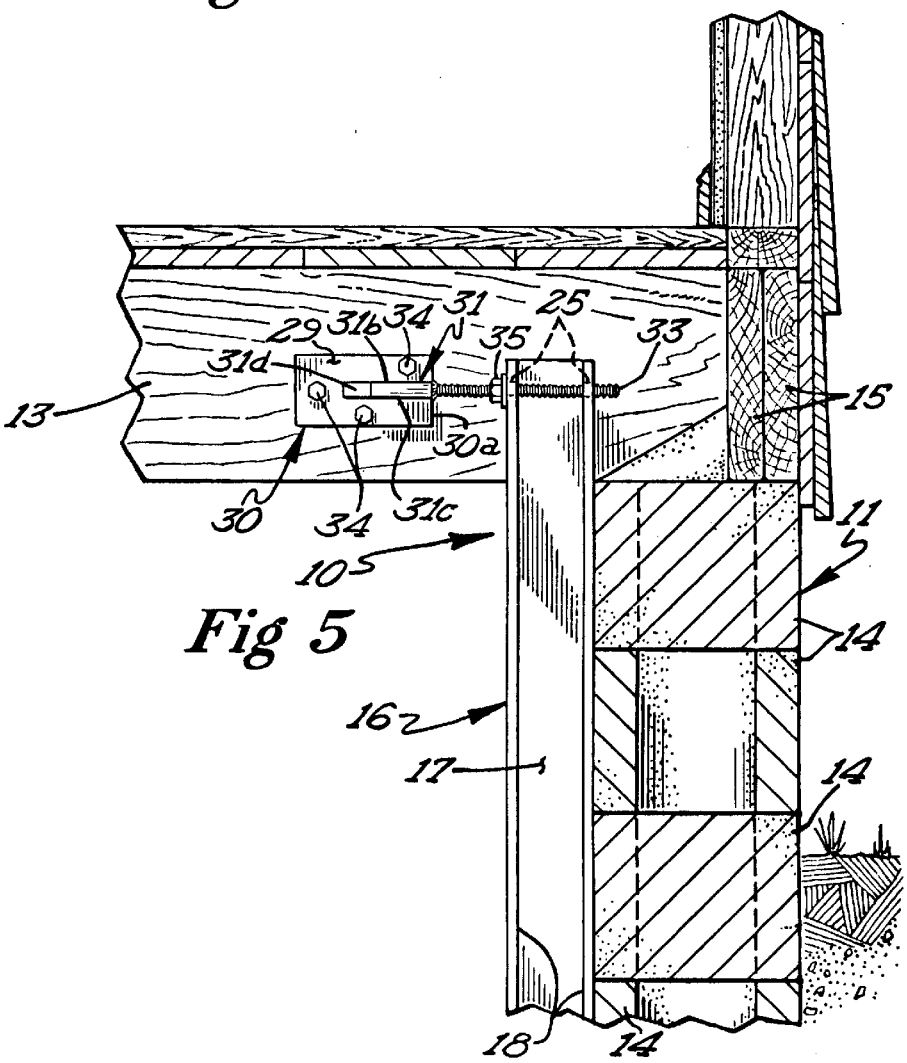
FIG. 5 is a side elevational view illustrating the manner n which the bracket of FIG. 4 is secured to a floor joist and urges beam against a basement wall.

Referring now to FIGS. 4 and 5, it will be seen that a different embodiment of the novel bracket is thereshown.

The bracket depicted in FIGS. 4 and 5 is designated generally by the reference numeral 30 and includes rectangular flat plate 30*a* having opposed surfaces 30*b*, parallel transverse edges 30, and parallel longitudinal edges 30*c*. The bracket plate 30*a* has a plate 31 rigidly secured thereto as by welding and projects outwardly therefrom. The plate 31 is of flat configuration having opposed parallel surfaces 31*b*, opposed parallel longitudinal edges 31, a straight transverse edge 31*a*, and an oblique transverse edge 31*d*. The plate 31 is secured to the bracket 30 along the longitudinal center line thereof and projects laterally therefrom. In the embodiment shown, the straight transverse edge 31*a* of the plate 31 is disposed in the same plane as a transverse edge 30*a* of the plate 30. The bracket plate 30*a* also has a plurality of openings 32 therein and three such openings are illustrated in the embodiment shown.

A pair of elongate threaded members 33 are rigidly secured to the edge 31*a* of the plate 31 and project outwardly therefrom. The threaded members 33 are disposed in spaced apart parallel relation and project through pairs of openings in the flanges 18 at the upper end of the I-beam 16 in the manner of the embodiment of FIGS. 1–3. In this regard, the threaded members 33 project through openings in the flanges on opposite sides of the central web 17. The bracket 30 is secured to a floor joist 13 in spaced relation to the masonry wall 11. It will be noted that the threaded members or bolts 33 are disposed in parallel relation with respect to the joist 13 to which the bracket 30 is secured. In the embodiment of FIGS. 1–3, the bolts 22 are disposed substantially normal to the joist to which the bracket 21 is attached. Lag bolts 34 threadedly engage the floor joist 13 to secure the bracket 30 to the joist. Suitable nuts 35 threadedly engage the bolts 33 and progressively urge the I-beam 16 against the masonry wall. The lower end of the I-beam 16 depicted in FIG. 5 is secured to the floor plate (not shown) in the manner of the embodiment of FIG. 1–3.

The I-beam 16 illustrated in FIG. 5 will engage the wall and cooperates with the bracket 30 and floor joist 13 to either prevent buckling of the wall due to hydrostatic pressure or eliminate the buckling that has previously occurred. One flange 18 of the I-beam 16 bears against the masonry wall to present a strong bearing surface in the manner of the embodiment of FIGS. 1–3.

Figure 6:
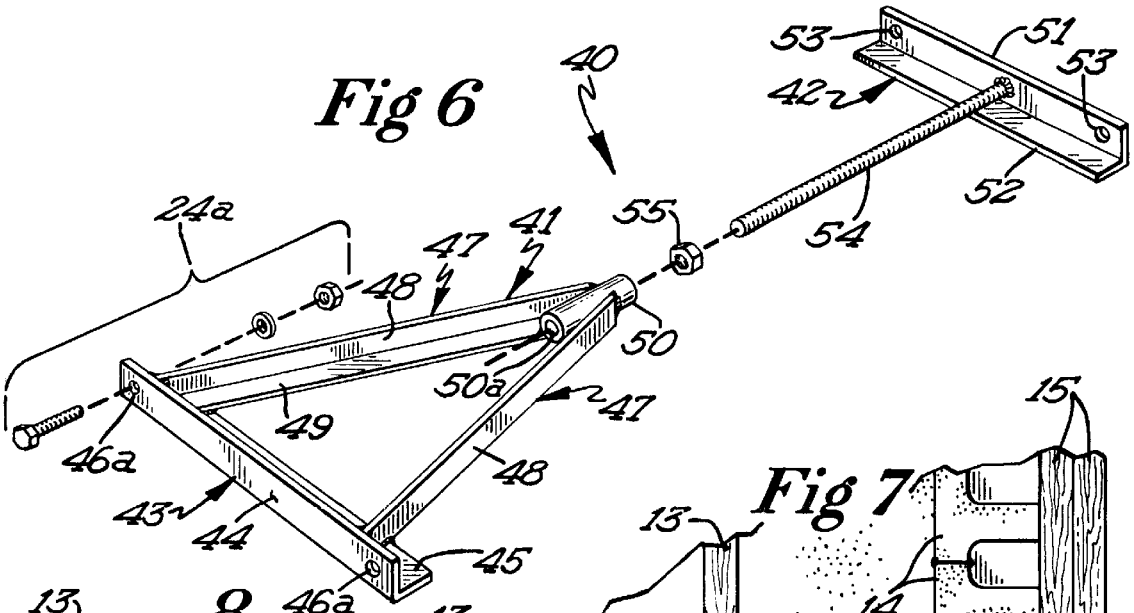
FIG. 6 is an exploded perspective view of a load distributing bracket assembly.
Figure 7:
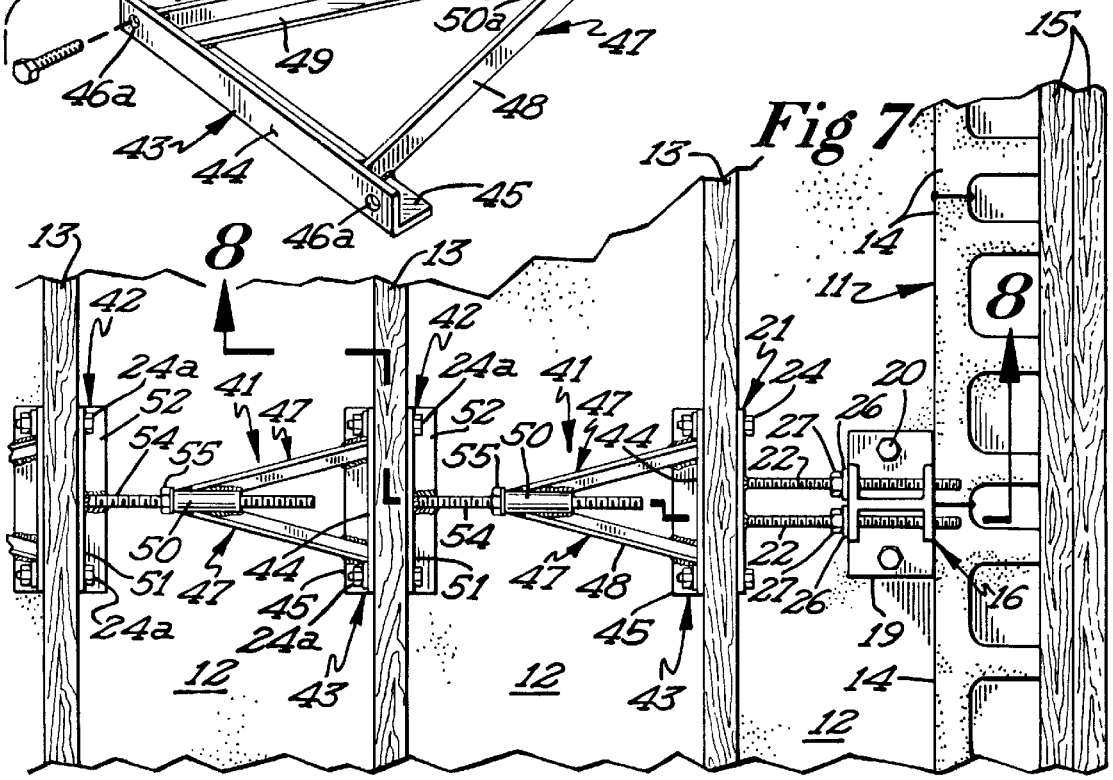
FIG. 7 is a partial top plan view of plurality of the load distributing bracket assemblies.
Figure 8:
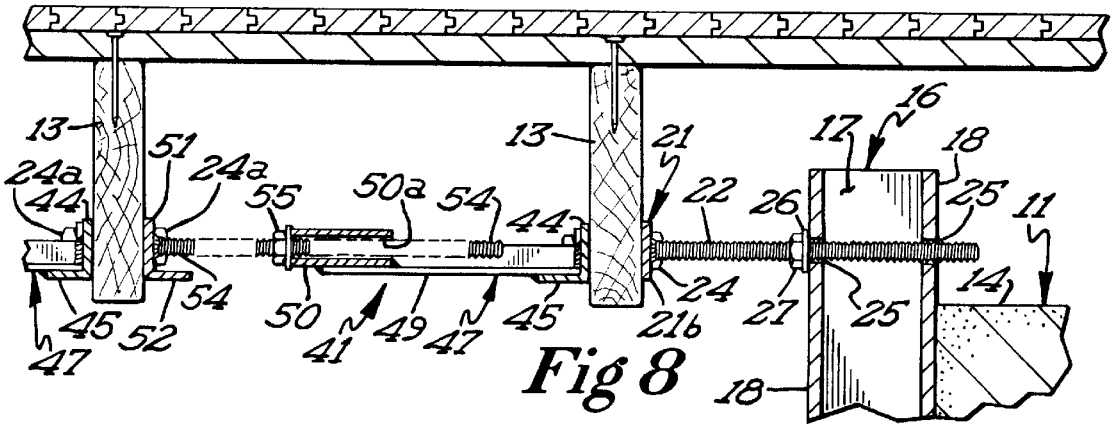
FIG. 8 is a cross-sectional view taken approximately along line 8—8 of FIG. 7 and looking in the direction of the arrows.

In many instances, it will be necessary to shore up the load transmitted from the I-beam to floor joist to which the bracket 21 is attached. Referring now to FIGS. 6–8, it will be seen that this load transmitted from the I-beam to the joist having the bracket attached thereto, is distributed to an adjacent and successive joists by means of load distributing bracket assemblies 40.

It will further be seen that each load distributing bracket assembly 40 includes triangular shaped bracket 41 and an angle bracket 42. The triangular bracket 41 is comprised of base member 43 of angle iron construction including a vertical flange 44 and a horizontal flange 45. The vertical flange 44 has a pair of openings 46 therein for accommodating the bolt of the nut and bolt assemblies 24.

The triangle bracket 41 also includes a pair of elongate legs 47 of angle iron construction, each having one end secured to an end portion of the base member 43 by welding or the like. The ends of the legs attached to the base member are spaced apart but the legs converge towards each other and are rigidly secured to a tubular member 50 by welding. Each leg includes a vertical flange 48 and a horizontal flange 49.

The tubular member 50 has a smooth unthreaded bore 50*a*therethrough and projects beyond the ends of legs 47. The triangular bracket 41 is secured the opposed surface of the same joist 13 having the bracket 21 secured thereto.

In this regard, the bolts 24 securing the bracket 21 to the joist 13 pass through openings in the joist and through openings 46*a* in the base member 43 of the triangular bracket 47. In the embodiment shown, the length dimension of bracket 21 is the same as the length dimension of base member 43.

The angle bracket 42 is of angle iron construction and includes a vertical flange 51 and horizontal flange 52. The vertical flange has spaced apart openings 53 therethrough. The length dimension of the angle bracket 42 is the same as the length dimension of the base member 43. Each opening 53 of the angle bracket is aligned with an opening 46*a* of the base member 43 and with an opening through the associated floor joist 13. Thus each angle bracket may be secured to a floor joist and to the triangular bracket 41 or the next adjacent load distributing bracket assembly 40. The angle bracket 42, of course, may be secured to the opposed floor joist only, if no additional load distributing bracket assemblies are used.

With this arrangement, load stress exerted on the first floor joist 13 via the I-beam 16 and bracket 21 may be distributed to the next adjacent joist or several other floor joists depending on the particular load. When the nut 55 of a load distributing bracket assembly is tightened against the tube 50, a force normal to both engaged floor joists and in opposite directions will be applied to floor joists. In FIG. 8, it will be seen that each load distributing bracket assembly engages opposed floor joists adjacent the bottom portions thereof. Since the floor joists are fixed to the subflooring at their upper edges, a very strong box-like load bearing system is provided. It is pointed out that one or several of the load distributing bracket assemblies may be used to distribute the load exerted on the initial loading bearing joist.

Several I-beams may be required to bolster a single masonry wall against buckling. In this arrangement, the I-beams will be spaced apart a few or several feet as required. Additional load distributing bracket assemblies may be required for each I-beam, bracket and floor joist.

It will therefore be seen from the foregoing description, that I have provided a novel and improved system for bracing basement walls against inward buckling which is easy to install and which functions in a more efficient manner than any heretofore known comparable system.

What is claimed is:

1. A bracing system for bracing the masonry wall of a basement of a building having laterally spaced apart floor joists and a basement floor, comprising;

an elongate vertically disposed I-beam engaging a wall to be braced and including a central web having opposed flanges integrally formed therewith;

means securing the I-beam to the basement floor, a bracket secured to one surface of the floor joist located adjacent the wall to be braced, said one surface facing the wall to be braced, elongate threaded means secured to the bracket and projecting through openings in the flanges of the I-beam at the upper end portion thereof adjustable means engaging said threaded means and said I-beam and being adjustable to progressively urge the I-beam against the masonry wall to be braced, said bracket, I-beam, lower end securing means, and floor joist bearing said bracket cooperating with each other to correct or prevent inward buckling of the wall due to external hydrostatic pressure.

2. The bracing system as defined in claim 1 and a load distributing bracket assembly extending between and engaging said wall adjacent floor joist and the next adjacent floor joist, said load distributing bracket assembly being adjustable to exert a force normal to each of the floor joist engaged by the load distributing bracket assembly.

3. The bracing system defined in claim 2 wherein said load distributing bracket assembly includes a triangular bracket engaging one of the engaged floor joists and an angle bracket engaging the other of the engaged floor joists, an elongate threaded member secured to said angle bracket, and adjustable means engaging said threaded member and said triangular bracket and being adjustable to progressively urge the triangular bracket and angle bracket against the engaged floor joists.

4. A bracing system for bracing the masonry wall of a basement of a building having laterally spaced apart floor joists and a basement floor, comprising;

an elongate vertically disposed I-beam engaging a wall to be braced and including a central web having opposed flanges integrally formed therewith;

a floor plate secured to the lower end of the beam, means securing the floor plate to the basement floor;

a bracket including a first flat plate generally positioned against a floor joist, disposed in spaced relation and adjacent the masonry wall to be braced, means securing said first plate to the floor joist, a second plate secured to said first plate in right angular relation therewith, and threaded means affixed to said second plate and projecting through openings on the upper end of the I-beam, said bracket cooperating with said floor plate I-beam, and floor joist for retaining said I-beam in engaging relation with a vertical masonry wall to correct or prevent inward buckling of the wall due to external hydrostatic pressure.

5. The bracing system as defined in claim 3 wherein said threaded means is affixed to an edge of the second plate and projects therefrom.

* * * * *